US005860051A

United States Patent [19]

Goto et al.

[11] Patent Number: 5,860,051

[45] Date of Patent: Jan. 12, 1999

[54] BELT-TYPE FIXING APPARATUS WITH PRESSURE ROLLER

[75] Inventors: Masahiro Goto; Toshio Miyamoto; Satoru Izawa; Masahiko Suzumi, all of Yokohama, Japan

[73] Assignee: Canon Kabushiki Kaisha, Tokyo, Japan

[21] Appl. No.: 651,907

[22] Filed: May 21, 1996

[30] Foreign Application Priority Data

May 22, 1995 [JP] Japan ..... 7-148113

[51] Int. Cl.[6] ..... G03G 15/20

[52] U.S. Cl. ..... 399/529; 399/333

[58] Field of Search ..... 219/216; 399/329, 399/331, 333

[56] References Cited

U.S. PATENT DOCUMENTS

| | | | |
|---|---|---|---|
| 4,200,389 | 4/1980 | Matsui et al. | 399/339 |
| 4,580,033 | 4/1986 | Sakurai | 219/216 |
| 4,804,576 | 2/1989 | Kuge et al. . | |
| 4,935,785 | 6/1990 | Wildi et al. | 399/324 |
| 5,051,784 | 9/1991 | Yamamoto et al. | 399/329 |
| 5,091,752 | 2/1992 | Okada | 399/329 |
| 5,153,660 | 10/1992 | Goto . | |
| 5,293,202 | 3/1994 | Adachi et al. . | |
| 5,331,385 | 7/1994 | Ohtsuka et al. | 399/331 |
| 5,420,679 | 5/1995 | Goto et al. . | |
| 5,621,510 | 4/1997 | Okuda et al. | 399/338 |

FOREIGN PATENT DOCUMENTS

| | | |
|---|---|---|
| 57-041660 | 3/1982 | Japan . |
| 61-022376 | 1/1986 | Japan . |
| 1-040869 | 2/1989 | Japan . |
| 2-157878 | 6/1990 | Japan . |
| 4-44075 | 2/1992 | Japan . |
| 4-44076 | 2/1992 | Japan . |
| 4-44077 | 2/1992 | Japan . |
| 4-44078 | 2/1992 | Japan . |
| 4-44079 | 2/1992 | Japan . |
| 4-44080 | 2/1992 | Japan . |
| 4-44081 | 2/1992 | Japan . |
| 4-44082 | 2/1992 | Japan . |
| 4-44083 | 2/1992 | Japan . |
| 4-204980 | 7/1992 | Japan . |
| 4-204981 | 7/1992 | Japan . |
| 4-204982 | 7/1992 | Japan . |
| 4-204983 | 7/1992 | Japan . |
| 4-204984 | 7/1992 | Japan . |
| 5-072935 | 3/1993 | Japan . |
| 7-036304 | 2/1995 | Japan . |

*Primary Examiner*—Robert Beatty
*Attorney, Agent, or Firm*—Fitzpatrick, Cella, Harper & Scinto

[57] ABSTRACT

An image fixing apparatus has a heater; a film; and a roller forming a nip with the heater with the film therebetween, the roller being driving to drive the film. A recording material carrying an unfixed image is fed by the nip so that the unfixed image is fixed on the recording material by heat from the heater, and the roller has a surface resin tube layer, wherein the center line average surface roughness Ra ($\mu$m), a dynamic friction coefficient $\mu$, and a peripheral speed of the roller V (mm/sec) satisfy:

when Ra 0.3, $$\mu \geqq 1.3\times10^{-3}V+0.18$$

when Ra$\geqq$0.3

$$0.37 \geqq Ra\times\mu \geqq 6.4\times10^{-4}V+4.8\times10^{-3}.$$

The roller's surface resin tube layer includes two different types of resin or resin and rubber materials. The roller's tube layer is subject to electric discharge treatment.

38 Claims, 6 Drawing Sheets

BELT-TYPE FIXING APPARATUS WITH PRESSURE ROLLER

FIELD OF THE INVENTION AND RELATED ART

The present invention relates to a fixing apparatus employed in an image forming apparatus such as a copying apparatus or a printer, and in particular, a roller employed in the fixing apparatus to convey a recording medium.

In recent years, a fixing apparatus of a heating film type has come to be employed in addition to a fixing apparatus of a heat roller type.

A thermal fixing apparatus of the heating film type had been proposed in Japanese Laid-Open Patent Application Nos. 323182/1988, 157878/1990, 44075/1992–44083/1992, 204980/1992–204984/1992, and the like publications. According to these publications, a heat resistant film is used as a heating member. It is run (or rotated) through the nip formed between a heat generating member (heater) and an elastic pressure roller serving as a pressing member. As the film is run (or rotated), the recording medium to be subjected to an image fixing thermal process is introduced into the nip, between the heat resistant film and the pressure roller, and is passed through the nip together with the heat resistant film. While the recording medium is passed through the nip, the image borne on the recording medium is fixed to the recording medium by the heat transmitted from the heat resistant film heated by the heater, and the pressure of the compression nip; the image borne on the recording medium is fixed as a permanent image to the recording medium surface by the heat and pressure in the nip.

In the case of the thermal fixing apparatus of the heating film type, a linear heating member with a low thermal capacity can be employed as the heating member, and a thin film also with a low thermal capacity can be employed as the heating film; therefore, electrical energy can be saved, and waiting time can be reduced (apparatus starts up quickly).

As for the structure of the means for rotating or running the heat resistant film as the heating member in the thermal fixing apparatus of the heating film type, a film driving system and a pressure roller driving system are known. In the case of the former, a driving roller is disposed on the interior surface side of the film to drive the film while tensioning the film, wherein the pressure roller as the pressure generating rotary member is caused to follow the film movement. In the case of the latter, the pressure roller as the pressure generation rotary member is driven, and the film rotates or runs following the pressure roller.

As for the pressure roller, one of the rollers comprises a metallic core and a silicon rubber layer disposed thereon, and the other comprises a metallic core, a silicon rubber layer, and an additional layer which is compound of fluorinated latex rubber containing fluorinated resin, and is coated on the silicon rubber layer. Either roller has a fault in that it is less durable than the pressure roller which has a resin tube, for example, a PFA tube, as the surface layer.

Further, the speed at which the recording medium or the film is conveyed in the image fixing thermal apparatus of the pressure roller driving type or the heating film driving type is determined by the peripheral velocity of the pressure roller; therefore, when the thermal expansion of the pressure roller as the driving roller is large, the peripheral velocity thereof is liable to change. When this occurs, the recording medium is not properly tensioned by the nip of the thermal fixing apparatus, and the image forming portions such as the image transfer portion of the image forming means, is liable to be excessively tensioned by the thermal fixing apparatus, which may produce a stretched or blurred image.

In order to solve this problem, it is necessary to reduce the thermal expansion coefficient. However, simply reducing the thickness of the elastic layer to reduce the thermal expansion coefficient makes it difficult to create a nip with a sufficient width, which in turn makes it difficult to increase the speed of the thermal fixing apparatus. This problem can be solved by providing the pressure roller with a surface layer composed of a resin tube such as a PFA tube. More specifically, the thermal expansion of the elastic layer is suppressed by the stress generated by the resin tube in the periphery-to-center direction, and as a result, the pressure roller is prevented from changing in the external diameter.

In the case of the pressure roller driving system, the pressure roller as the pressure generating rotary member sometimes fails to provide a sufficient driving force to convey the member pinched in the nip in a preferable manner.

When the driving-conveying force of the pressure roller in the image fixing thermal apparatus employing the pressure roller driving system or the heating film driving system is insufficient, slipping occurs between the pressure roller and the recording medium while the recording medium is passed between the film and the pressure roller, which prevents the recording medium from being conveyed in the preferable manner. This phenomenon, which results in poor fixing performance, is more liable to occur when a PFA tube, which is superior in the mold releasing properties and durability, is employed as the surface layer of the pressure roller.

SUMMARY OF THE INVENTION

Accordingly, the primary object of the present invention is to provide a fixing apparatus comprising a durable roller capable of conveying the recording medium without slipping.

Another object of the present invention is to provide a fixing apparatus comprising a roller with a reduced thermal expansion coefficient, which is capable of conveying the recording medium without slipping.

According to an aspect of the present invention, the driving roller is provided with a surface layer of resin tube, wherein the relationship among the surface roughness of the resin tube layer Ra ($\mu$m), the dynamic friction coefficient ($\mu$), and the peripheral velocity of the roller V (mm/sec) is:

$$\mu \geqq 1.3\times10^{-3}V+0.18 \text{ (when } Ra<0.3)$$

or $$0.37 \geqq Ra\times\mu \geqq 6.4\times10^{-4}V+4.8\times10^{-3} \ (Ra \geqq 0.3).$$

Another object of the present invention is to provide a fixing apparatus comprising a pressure generating driving roller whose surface layer is composed of a blasted resin tube.

Another object of the present invention is to provide a fixing apparatus comprising a pressure generating driving roller whose surface layer is composed of a tube of fluorinated resin material in which a resin material other than the fluorinated resin is mixed.

Another object of the present invention is to provide a fixing apparatus comprising a pressure generating driving roller whose surface layer is composed of a tube of a resin material in which rubber material is mixed.

Another object of the present invention is to provide a fixing apparatus comprising a pressure generating driving roller whose surface layer is composed of a tube of a resin material, wherein the surface of the tube has been subjected to electrical discharge.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1 (FIGS. 1–4)

(1) Example of image forming apparatus

Figure 1:
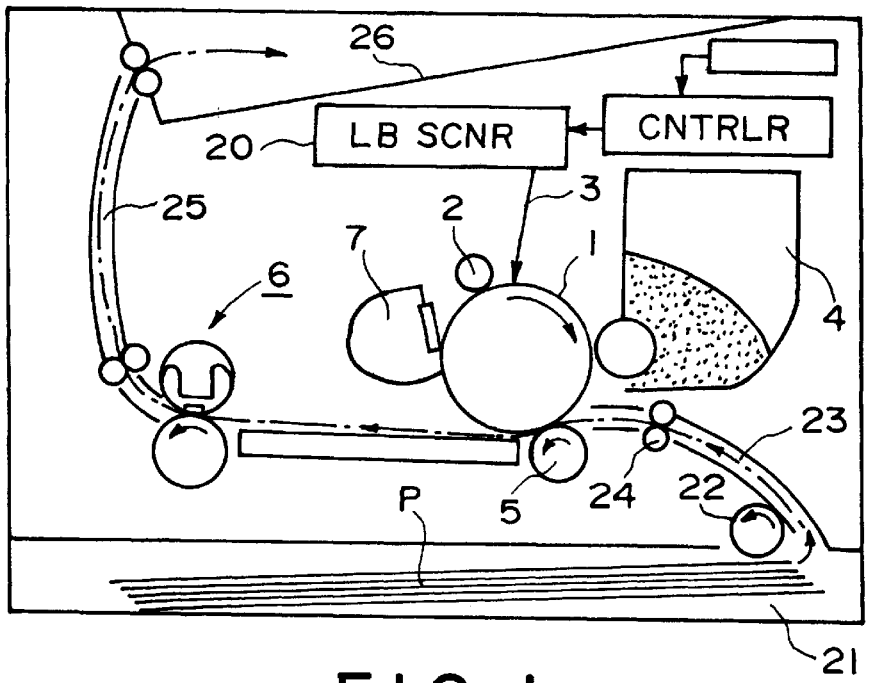
FIG. 1 is a schematic sectional view of an image forming apparatus in the first embodiment of the present invention.

FIG. 1 is a schematic sectional view of an example of an image forming apparatus. In this embodiment, the image forming apparatus is a laser beam printer which employs an electrophotographic process and a transfer system.

In the drawing, a reference numeral 1 designates an electrophotographic photosensitive member in the form of a rotary drum (hereinafter, photosensitive drum), which serves as an image bearing member. It is rotated in the clockwise direction indicated by an arrow mark, at a predetermined peripheral velocity (process speed). The photosensitive drum 1 comprises a cylindrical base member composed of aluminum, nickel, or the like materials, and a layer of photosensitive material such as OPC, amorphous Se, amorphous Si, or the like material, which is formed on the surface of the base member.

A reference numeral 2 designates a charge roller as a primary charging means for uniformly charging the peripheral surface of the photosensitive drum 1 to a predetermined polarity and a predetermined potential.

The surface of this rotary photosensitive drum 1, which has been charged through the primary charging process, is exposed to a scanning laser beam 3 projected from a laser beam scanner 20 which turns the laser beam on or off in response to imaging data. As a result, an electrostatic latent image is formed.

A reference numeral 4 designates a developing means, which develops the electrostatic latent image formed on the surface of the rotary photosensitive drum 1, into a toner image. As for the developing method, the jumping method, the two component developing method, the FEED developing method, or the like, is frequently employed; the image exposure and reversal development are employed in combination. A reference numeral 5 designates a transfer roller as a transferring means. A transfer material as a recording medium placed in a sheet feeder cassette 21 is delivered, with a predetermined timing, to a transfer portion formed between the rotary photosensitive drum 1 and the transfer roller 5, by way of a sheet feeder roller 23, a sheet path 23, and a registration roller pair 24. In the transfer portion, the toner image on the surface of the rotary photosensitive drum 1 is transferred onto the transfer material P.

The transfer material P having been passed through the transfer portion is separated from the surface of the photosensitive drum 1 by an unillustrated separating means, and is conveyed to an image fixing thermal apparatus 6 as a heating apparatus, and is introduced into the image fixing apparatus 6, in which the toner image is thermally fixed to the transfer material P. Thereafter, the transfer material P is discharged into a sheet catcher 26 through a sheet path 25.

A reference numeral 7 designates a drum cleaning means, which cleans the photosensitive rotary drum surface after the toner image is transferred onto the transfer material P. The photosensitive drum 1 is repeatedly subjected to the image forming operation after cleaning.

(2) Image fixing thermal apparatus 6

Figure 2:
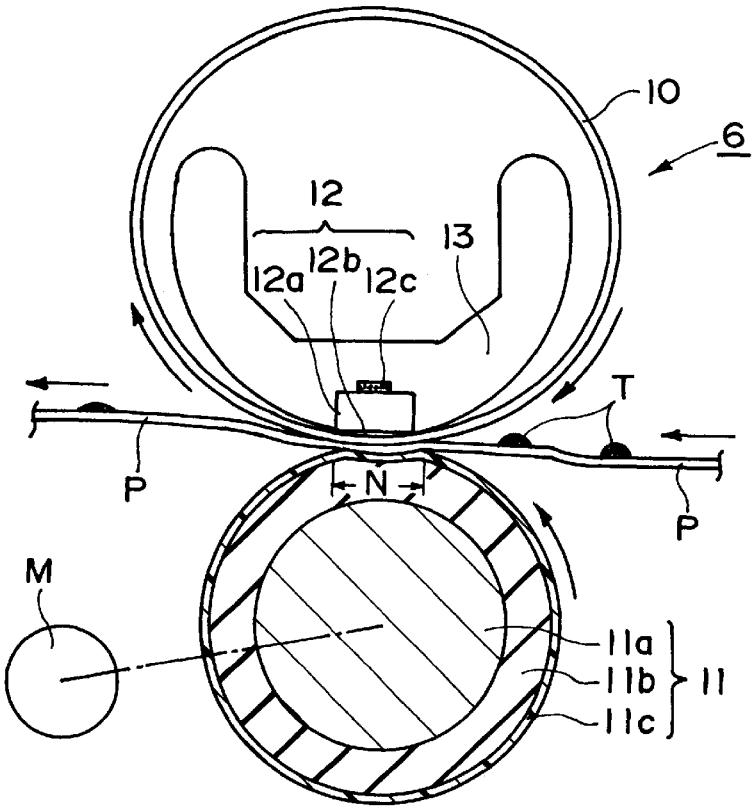
FIG. 2 is a schematic sectional view of the structure of the fixing apparatus portion in an image forming apparatus.

FIG. 2 is an enlarged schematic sectional view of the image fixing thermal apparatus 6 as the heating apparatus. The apparatus 6 in this embodiment is of a type comprising a heating film and a driving pressure roller; in other words, it is a so-called tensionless type apparatus.

A reference numeral 10 designates a heat resistant film in the form of an endless belt (hereinafter, fixing film). It is loosely fitted around a film guide member 13 (stay). The film guide member 13 is shaped like a trough with a substantially semicircular cross-section, and holds a heater 12 as the heating member, which extends on the longitudinal center line of the downward facing surface of the film guide.

In this embodiment, the thermal capacity of the fixing film was reduced to improve the startup speed of the apparatus; the overall thickness of the fixing film 10 was no more than 100 $\mu$m, more preferably, no less than 20 $\mu$m and no more than 60 $\mu$m. It was a single layer film or PTFE, PFA, PPS, or the like, which had heat resistance, mold releasing properties, outstanding durability, and the like properties, or a compound layer film comprising a base film of polyimide, polyamideimide, PEEK, PES, or the like, and a layer of PTFE, PFA, FEP, or the like which is coated as a mold releasing layer on the base film.

The heater 12 is a ceramic heater with a low thermal capacity, for example. It comprises a substrate 12*a* of alumina or the like ceramic having heat resistance, insulating properties, and a low thermal capacity, and an exothermic member 12*b* (heat generating resistor) as a heat generating source which is extended on the substrate surface in the longitudinal direction of the substrate. As the heat generating resistor 12 generates heat, the temperature of the ceramic heater increases. The increased temperature of the heater is detected by a temperature detecting element such as a thermistor disposed on the substrate 12*a,* wherein the power supply to the heat generating resistor 12*b* is controlled in response to the detected temperature data so that the temperature of the heater 12 is adjusted to a predetermined temperature.

A reference numeral 11 designates an elastic pressure roller. It is disposed so as to press on the heater 12, interposing the film 10, against the elasticity of the roller, whereby a compression nip (hereinafter, fixing nip) N having a predetermined width is formed between the heater 12 and the pressure roller 11, the film 10 being pinched in the nip N by the elastic force generated by the deformation of the elastic layer of the pressure roller 11. The structure and the characteristics of the pressure roller 11 will be described in the following description (3).

The pressure roller 11 is rotated in the counterclockwise direction by a driving system M at a predetermined peripheral speed, that is, a speed substantially the same as the speed at which the transfer material P bearing a toner image T yet to be fixed is conveyed as an object to be heated, from the image transfer portion of the image formation process means; therefore, the transfer material P is conveyed without being wrinkled (pressure roller driving system). In the fixing nip N, the rotational force of the pressure roller 11 is transmitted to the film 10 by the friction generated between the roller 11 and the outward facing surface of the film 10, causing the film 10 to follow the rotation of the pressure roller 11 in the clockwise direction indicated by an arrow mark around the film guide member 13, with the inward facing surface of the film 10 sliding on the downward facing surface of the heater 12. In order to reduce the resistance generated between the inward facing surface of the film 10, and the heater surface on which the film 10 slides, lubricant such as heat resistant grease may be applied between the two.

Thus, at least during an actual fixing operation, the film 10 is circularly driven by the rotation of the pressure roller 11, and electrical power is supplied to start up the heater 12 to a predetermined temperature at which the heater temperature is kept by temperature control. As the transfer material P carrying the toner image T yet to be fixed is introduced as the object to be heated, from the image transfer portion of the image formation process means into the fixing nip N, with the toner image carrying surface facing the film 10, the pressure roller 11 comes in contact with the back surface of the introduced transfer material P, applying the rotational force of the pressure roller 11 to the introduced transfer material P, whereby the introduced transfer material P is conveyed through the fixing nip N together with the film 10, with the introduced transfer material P remaining airtightly in contact with the outward facing surface of the film 10.

While the introduced transfer material P is passed through the fixing nip, the toner image T carried on the transfer material P yet to be fixed is thermally fixed to the transfer material P by the heat of the heat resistant film 10 as the heating member heated by the heater 12.

After passing through the fixing nip N, the transfer material P is separated from the outward facing surface of the film 10, and is discharged into the sheet catcher 26.

(3) Pressure roller 11 a) Structure and manufacturing steps

The pressure roller 11 as the pressure generating rotary member in this embodiment comprised a metallic core 11*a* of iron, aluminum, or the like, an elastic layer 11*b* of silicone rubber fitted around the peripheral surface of the metallic core 11*a,* and a resin tube layer 11*c* as a mold releasing layer fitted around the external peripheral surface of the elastic layer 11*b*.

The pressure roller 11 was manufactured following the steps described below. First, a resin tube such as a PFA tube which would become the mold releasing layer 11*c* was coated with primer, on the internal surface, and then was placed in a cylindrical roller mold. Next, the surface of the metallic core 11*a* of iron, aluminum, or the like, was roughened by blasting, and cleansed. Then, the metallic core 11*a* was set at the center of the cylindrical roller mold. Thereafter, liquid silicone rubber was injected into the space between the metallic core 11*a* set at the center of the mold, and the resin tube 11*c*, and was hardened by heat to form the elastic layer 11*b*. The primer having had been coated on the internal surface of the resin tube bonded the resin tube 11*c* and the rubber layer 11*b* while the liquid silicon rubber was thermally hardened into the elastic layer 11*b*. The pressure roller molded through the above steps was removed from the mold, and was further hardened.

b) Various tests and evaluations

In order to prevent the slipping which occurs between the pressure roller comprising the resin tube layer as the mold releasing layer 11*c*, and the transfer material P, while maintaining preferable mold releasing properties, the inventors of the present invention conducted various tests, and carefully studied the test results, discovering that the peripheral velocity V (mm/sec) at which the pressure roller 11 was rotatively driven, the roughness Ra (center line average height) of the resin tube surface, and also the dynamic friction coefficient $\mu$ were the essential parameters for accomplishing both objectives. Next, the details of the discovery will be described.

The image fixing thermal apparatus 6 used in these tests and evaluations was a tensionless type apparatus which employed the system in which the heating film was driven by the pressure roller as illustrated in FIG. 2.

The pressure roller 11 comprised an aluminum core 11*a* with a diameter of 16 mm, a 3 mm thick silicone rubber layer 11*b,* and a 50 $\mu$m thick mold releasing layer 11*c* of fluorinated resin tube.

The fluorinated resin tube as the mold releasing layer 11*c* was a resin tube composed of PTFE (tetrafluoroethylene), PFA (tetrafluoroethylene-perfluoroalkylvinylether copolymer), FEP (tetrafluoroethylene-hexafluoropropylene copolymer), ETFE (tetrafluoroethylene-ethylene copolymer), PCTFE (ethylene chloride trifluoride), or the like, the surface of which had been roughened by a predetermined treatment such as blasting.

The fixing nip N was formed by placing the pressure roller 11 in contact with the heater 12, interposing the fixing film 10, with an overall contact pressure of 5 kg. From the standpoint of assuring preferable fixing performance, the overall contact pressure was preferred to be no less than 3 kg.

The fixing film 10 as the heating member was a seamless tube of 40 $\mu$m thick polyimide film coated with a 10 $\mu$m thick PTFE layer.

An electric power of 500 W was supplied to the heater 12 to rotate the pressure roller 11 at a velocity V of 150 mm/sec.

1) Evaluation of slipping

Presence or absence of slipping between the pressure roller 11. and the transfer material P was observed while 100 letter size sheets as the transfer material P, which had been left in an environment with a temperature of 30° C. and a humidity of 80% for a duration of no less than 24 hours, were continuously fed.

2) Evaluation of mold releasing properties

The mold releasing properties of the surface of the pressure roller 11 were visually evaluated; 300,000 letter size sheets were fed within an environment with normal temperature and humidity to find out the ordinal number of the sheet at which a toner stain was spotted on the surface of the pressure roller.

The results of evaluations 1) and 2) are given in Table 1.

TABLE 1

| Tube | | Surface roughness Ra < 0.3 μm | Ra = 0.3 μm | Ra = 0.8 μm | Ra = 1.0 μm | Ra = 2.5 μm |
|---|---|---|---|---|---|---|
| PTFE | (1) | N | N | N | G | G |
| μ = 0.1 | (2) | G | G | G | G | F |
| PFA | (1) | N | N | G | G | G |
| μ = 0.2 | (2) | G | G | G | G | N |
| FEP | (1) | N | N | G | G | G |
| μ = 0.3 | (2) | G | G | F | F | N |
| ETFE | (1) | G | G | G | G | G |
| μ = 0.4 | (2) | G | G | F | N | N |
| PCTFE | (1) | G | G | G | G | G |
| μ = 0.37 | (2) | G | G | F | F | N |

and the surface stain (durability) of the pressure roller, and that a preferable results can be obtained when (Ra×μ) is no less than 0.1 and no more than 0.37.

When Ra is no more than 0.3 μm, that is, when the pressure roller surface is not roughened, being a virtually mirror surface, Ra dependency is small, and the value of the μ becomes more influential than the value of (Ra×μ); it is evident from Table 1 that the preferable results can be obtained when the value of μ is no less than 0.37.

The above described dependency of the pressure roller slipping on the surface roughness Ra and the dynamic friction coefficient μ occurs because the friction generated between the sheet and the pressure roller is reduced by the water vapor from the sheet. Therefore, when the value of the surface roughness Ra of the pressure roller is large, not only the dynamic friction coefficient μ, but also the surface irregularities which serve as the escape route for the water vapor, become the essential factors. Further, it is possible to think that when the surface roughness Ra is no more than 0.3 μm, virtually no escape route is available for the water vapor, increasing the dependency on the dynamic friction coefficient.

The durability is reduced when the toner can easily fill the irregularities. However, even when the toner can easily fills the irregularities, the toner which easily fills the irregularities easily falls off the irregularities as long as the dynamic friction coefficient μ is small; therefore, the pressure roller is less liable to be stained. In other words, the durability is also dependent on the product of the dynamic friction coefficient μ and the surface roughness Ra as described in the foregoing.

TABLE 2

| Ra × μ | 0.03 | 0.06 | 0.07 | 0.09 | 0.10 | 0.11 | 0.12 | 0.14 | 0.2 | 0.24 | 0.25 | 0.3 | 0.31 | 0.32 | 0.37 | 0.4 | 0.5 | 0.75 | 0.93 | 1.0 |
|---|---|---|---|---|---|---|---|---|---|---|---|---|---|---|---|---|---|---|---|---|
| Slip | N | N | N | N | G | G | G | G | G | G | G | G | G | G | G | G | G | G | G | G |
| Durability | G | G | G | G | G | G | G | G | G | F | F | F | F | F | F | N | N | N | N | N |

In Table 1, regarding 1) evaluation of slipping, a symbol "G" indicates absence of slipping during the feeding of the sheets, and a symbol "N" indicates that occurrence of slipping was confirmed; regarding 2) evaluation of mold releasing properties, the symbol "G" stands for absence of the pressure roller stain after the feeding of 300,000 sheets, a symbol "F" stands for presence of the roller stain after the feeding of 200,000 to 300,000 sheets, and the symbol "N" stands for presence of the roller stain after the feeding of no more than 200,000 sheets.

As is evident from Table 1, the rougher the surface of the resin tube 11*c* as the mold releasing layer, the less liable the slipping was no occur, but the more liable the pressure roller 11 was to be soiled. Also, the optimum roughness values for various tube materials were different.

Table 2 shows how the slipping or the pressure roller stain changes for each tube listed in Table 2, depending on the value of (Ra×μ), that is, the product of the surface roughness Ra and the dynamic friction coefficient μ.

The dynamic friction coefficient μ of each tube in this table wag obtained by sliding each tube on a steel plate whose surface was mirror finished, at a speed of 3 m/min while applying a load of 7 kg/cm$^2$. Its value was 0.1 for PTFE, 0.2 for PFA, 0.3 for FEP, 0.4 for ETFE, and 0.37 for PCTFE, wherein the surface roughness Ra for each tube was 0.3 or less.

It is evident from the results given in Table 2 that there is a correlation between the product (Ra×μ) of the surface roughness Ra of the resin rube 11*c* as the mold releasing layer, that is, the surface layer of the pressure roller, and the dynamic friction coefficient μ of the same, and the slipping Next, the results of an experiment similar to the preceding experiments, in which the peripheral velocity of the pressure roller was 80 mm/sec, are given in Table 3.

TABLE 3

| Tube | | Surface roughness Ra < 0.3 μm | Ra = 0.3 μm | Ra = 0.8 μm | Ra = 1.0 μm | Ra = 2.5 μm |
|---|---|---|---|---|---|---|
| PTFE | (1) | N | N | G | G | G |
| μ = 0.1 | (2) | G | G | G | G | F |
| PFA | (1) | N | G | G | G | G |
| μ = 0.2 | (2) | G | G | G | G | N |
| FEP | (1) | G | G | G | G | G |
| μ = 0.3 | (2) | G | G | F | F | N |
| ETFE | (1) | G | G | G | G | G |
| μ = 0.4 | (2) | G | G | F | N | N |
| PCTFE | (1) | G | G | G | G | G |
| μ = 0.37 | (2) | G | G | F | F | N |

TABLE 4

| Ra × μ | 0.03 | 0.06 | 0.08 | 0.09 | 0.10 | 0.11 | 0.12 | 0.14 | 0.2 | 0.24 | 0.25 | 0.3 | 0.31 | 0.32 | 0.37 | 0.4 | 0.5 | 0.75 | 0.93 | 1.0 |
|---|---|---|---|---|---|---|---|---|---|---|---|---|---|---|---|---|---|---|---|---|
| Slip | N | G | G | G | G | G | G | G | G | G | G | G | G | G | G | G | G | G | G | G |
| Durability | G | G | G | G | G | G | G | G | G | F | F | F | F | F | F | N | N | N | N | N |

Table 4 was derived from Table 3 to sum up the relationship between the pressure roller slip, and the durability, with reference to the product (Ra×$\mu$) of the surface roughness Ra of the resin tube 11$c$ as the mold releasing layer, and the dynamic friction coefficient $\mu$.

It is evident from the results given in Table 4 that the product (Ra×$\mu$) of the surface roughness Ra of the resin tube 11$c$ a the surface layer of the pressure roller, and the dynamic friction coefficient $\mu$, have a correlation with the slipping and the surface stain (durability) of the pressure roller; the preferable results can be obtained when (Ra×$\mu$) is no less than 0.06 and no more than 0.37.

When Ra is no more than 0.3 $\mu$m, that is, when the pressure roller surface is not roughened, being a virtually mirror surface, Ra dependency is small, and the value of the $\mu$ becomes more influential than the value of (Ra×$\mu$), it is evident from Table 3 that the preferable results can be obtained when the value of $\mu$ is no less than 0.37.

It is also evident from the preceding data that the contamination of the pressure roller, which occurs through usage, has no dependency on the peripheral velocity of the pressure roller, but the slipping correlates to the dynamic friction coefficient $\mu$ of the pressure roller and the peripheral velocity of the pressure roller.

In order to clarify the above correlation, the following experiment was conducted, in which the value of the dynamic friction coefficient $\mu$ was varied using the resin tube 11$c$ composed of a blend of the aforementioned fluorinated resins, as the surface layer of the pressure roller, and the value of the dynamic friction coefficient $\mu$ was varied as shown below.

When PFA:ETFE=3:1, $\mu$ was 0.25, and when PFA:ETFE=1:2, $\mu$ was 0.34. Otherwise, this experiment was the same as the preceding ones.

The results are given in Table 5. Table 5 shows the relationship among the peripheral velocity V of the pressure roller, choice of tube material, the surface roughness Ra of the tube surface, and the occurrence of the slipping, but does not show the durability evaluation. In Table 5, symbols ≠ and = indicate occurrence and non-occurrence of the slipping, respectively. These results reveal that the slipping correlates to each of the peripheral velocity V of the pressure roller, the surface roughness Ra of the pressure roller, and the dynamic friction coefficient $\mu$, and also, the higher the peripheral velocity V of the pressure roller, the greater the dynamic friction coefficient $\mu$ and the surface roughness Ra must be in order to increase the grip of the pressure roller relative to the sheet.

TABLE 5

(SLIP)

| Tube | Peripheral speed 150 (mm/sec) | 120 | 80 | 60 | |
|---|---|---|---|---|---|
| PTFE | N | N | N | N | Ra < 0.3 $\mu$m |
| $\mu$ = 0.1 | N | N | N | G | Ra = 0.4 $\mu$m |
| PFA | N | N | N | N | Ra < 0.3 $\mu$m |
| $\mu$ = 0.2 | N | G | G | G | Ra = 0.4 $\mu$m |
| PFA + ETFE | N | N | N | G | Ra < 0.3 $\mu$m |
| (3:1) | G | G | G | G | Ra = 0.4 $\mu$m |
| $\mu$ = 0.25 | | | | | |
| FEP | N | N | G | G | Ra < 0.3 $\mu$m |
| $\mu$ = 0.3 | G | G | G | G | Ra = 0.4 $\mu$m |
| PFA + ETFE | N | G | G | G | Ra < 0.3 $\mu$m |
| (1:2) | G | G | G | G | Ra = 0.4 $\mu$m |
| $\mu$ = 0.34 | | | | | |
| ETFE | G | G | G | G | Ra < 0.3 $\mu$m |
| $\mu$ = 0.4 | G | G | G | G | Ra = 0.4 $\mu$m |

TABLE 5-continued (SLIP)

| Tube | Peripheral speed 150 (mm/sec) | 120 | 80 | 60 | |
|---|---|---|---|---|---|
| PCTFE | G | G | G | G | Ra < 0.3 $\mu$m |
| $\mu$ = 0.37 | G | G | G | G | Ra = 0.4 $\mu$m |

Figure 3:
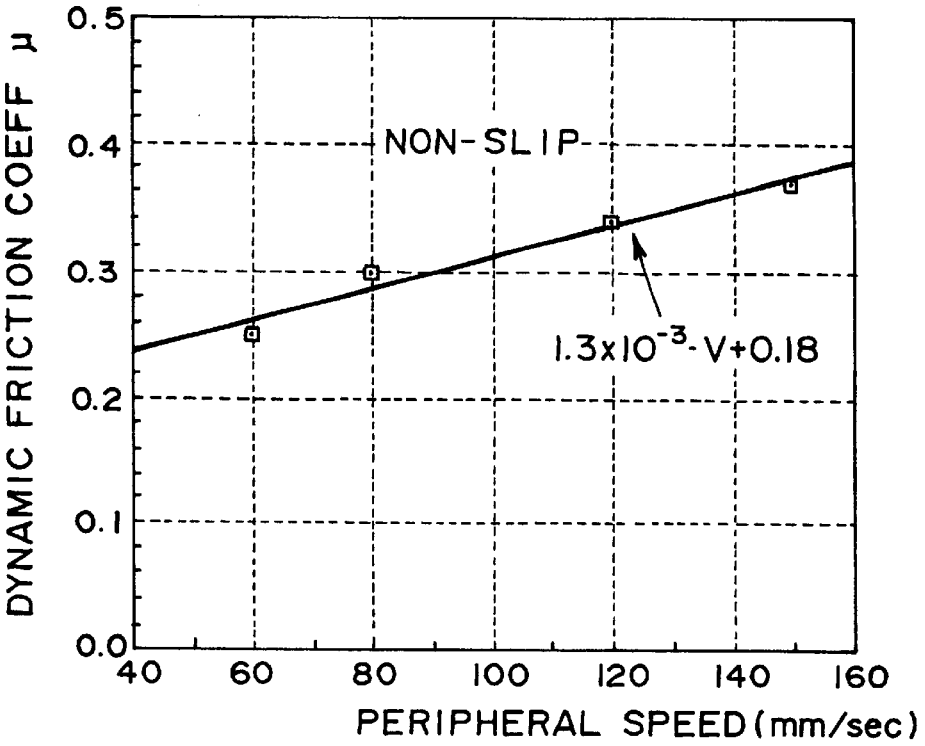
FIG. 3 is a graph showing the range in which slipping occurs to a pressure roller.
Figure 4:
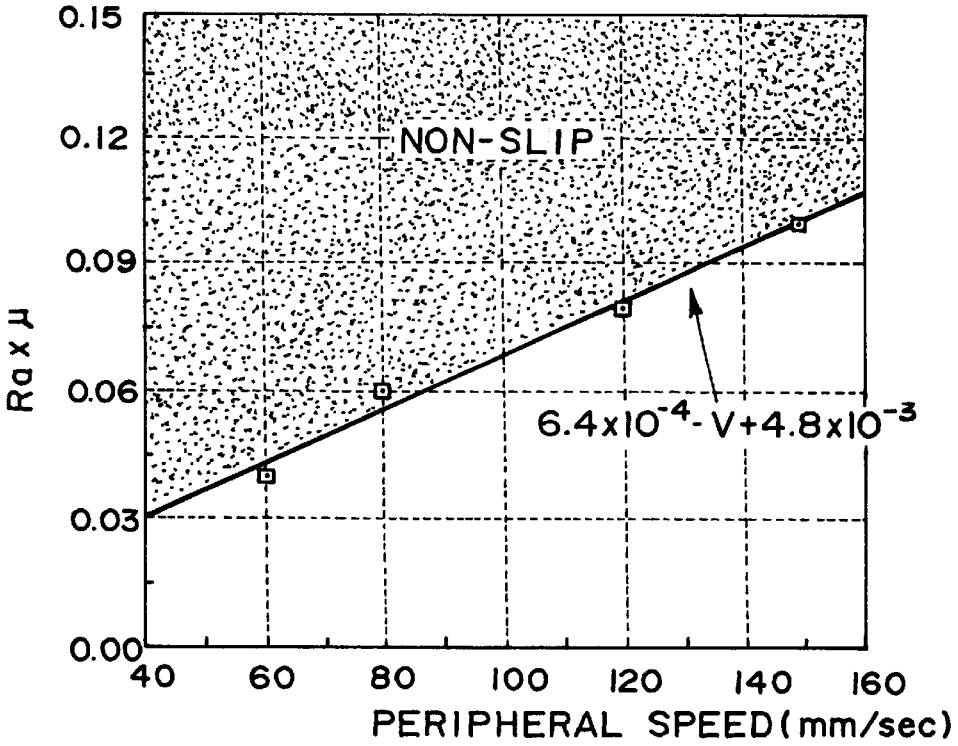
FIG. 4 is a graph also showing the range in which slipping occurs to a pressure roller.

Combining the preceding experiment and this experiment, the relationship between the peripheral velocity of the pressure roller and the dynamic friction coefficient $\mu$ when the surface roughness Ra was no more than 0.3 $\mu$ is given as a graph in FIG. 3, and the relationship between the peripheral velocity of the pressure roller and (Ra×$\mu$) when the surface roughness Ra was no less than 0.3 $\mu$m is given as a graph in FIG. 4.

According to the graph in FIG. 3, when Ra is no more than 0.3 $\mu$m, a non-slip pressure roller can be obtained as long as the relationship between the peripheral velocity V of the pressure roller and the dynamic friction coefficient $\mu$ satisfies:

$$\mu \geqq 1.3\times10^{-3}V+0.18$$

According to the graph in FIG. 4, when Ra is no less than 0.3 $\mu$, a nonslip pressure roller can be obtained as long as the product (Ra×$\mu$) of the dynamic friction coefficient $\mu$ and the surface roughness Ra of the pressure roller surface satisfies:

$$Ra\times\mu \geqq 6.4\times10^{-4}V+4.8\times10^{-3}$$

As described above, when a resin tube is used as the surface layer of the pressure roller, a driving pressure roller, which can maintain superior mold releasing properties for a long time, is stable in sheet conveyance properties, and is superior in manufacturability, can be obtained as long as the relationship among the peripheral velocity V of the pressure roller, the surface roughness Ra of the pressure roller, and the dynamic friction coefficient $\mu$ of the pressure roller surface satisfies:

$$\mu \geqq 1.3\times10^{-3}V+0.18\ (Ra<0.3\ \mu m)\ 0.37 \geqq Ra\times\mu \geqq 6.4\times10^{-4}V+4.8\times10^{-3}\ (Ra \geqq 0.3\ \mu m)$$

In other words, it becomes possible to use a resin tube such as a PFA tube as the surface layer of the rotary member. As a result, it is possible to provide the pressure generating rotary member with stable and durable mold releasing properties while preventing the slipping which occurs between the pressure generating rotary member and the member pinched in the nip. Further, the thermal expansion of the pressure generating rotary member can be suppressed by the function of the resin tube as the mold releasing surface layer. Thus, the pressure generating rotary member is provided with preferable sheet conveying properties.

Embodiment 2

This embodiment relates to the improvement of the pressure roller 11 to be employed in the thermal fixing apparatus described in the first embodiment.

The thermal fixing apparatus of this embodiment employed a structure similar to that of the first embodiment, except for a modification which was made to increase the pressure of the thermal fixing apparatus in order to provide the apparatus with a higher fixing capacity necessary to deal with a higher processing speed.

Among various fluorinated materials for the fluorinated tube as the mold releasing layer 11*c* of the pressing roller 11, which were described in the first embodiment, ETFE, PCTFE, and FEP were slightly inferior to PFA, PTFE, and the like, in heat resistance. In particular, they are liable to tear when subjected to a high temperature for an extended period of time. According to the experiment conducted by the inventors of the present invention, this phenomenon became conspicuous when the pressure of the thermal fixing apparatus exceeded 7 kg.

Therefore, researches were made on the tube structure in order to make the pressure roller heat resistant and strong enough to withstand the increased pressure, and at the same time, to satisfactorily function as the driving pressure roller. As a result, the resin tube 31*c* as the surface layer of this embodiment was obtained, in which a resin material such as nylon, PPS, PEEK, or the like, excluding fluorinated resins, which had high heat resistance and a high friction coefficient, was mixed into PFA resin.

Figure 5:
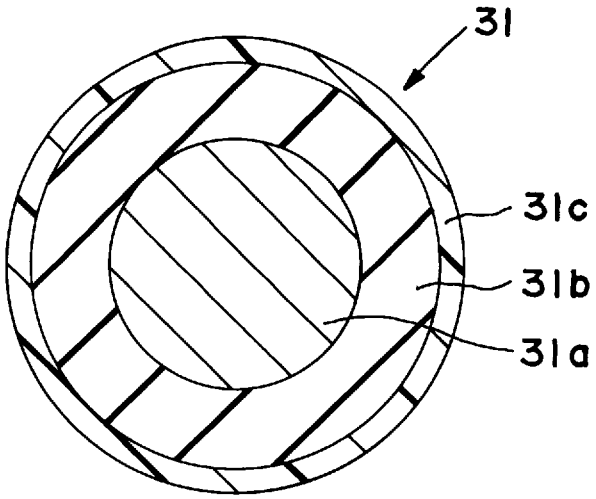
FIG. 5 is a sectional view of the pressure roller structure in another embodiment of the present invention.

The laminated structure of the pressing rollers 31 is as shown in FIG. 5. The structure of the thermal fixing apparatus was the same as that of the first embodiment; therefore, the description thereof will be omitted.

In this embodiment, the mold releasing layer 31*c* of the pressure roller 31 was a tube composed of a compound material made by mixing a heat resistant resin such as nylon, PPS, PEEK, or the like, into PFA. It was manufactured by extruding a mixture of PFA pellets and heat resistant resin pellets such as nylon pellets.

The essential steps for manufacturing the pressure roller were the same as those described in the first embodiment. First, a 50 $\mu$m thick tube of PFA containing heat resistant resin, which would become the mold releasing layer 31*c*, was coated with primer, on the internal surface, and then was placed in a cylindrical roller mold. Next, the surface of the metallic core 31*a* of aluminum was roughened by blasting, and cleansed. Then, the metallic core 31*a* was set at the center of the cylindrical roller mold. Thereafter, liquid silicone rubber was injected into the space between the metallic core 31*a* set at the. center of the mold, and the resin tube 31*c*, and was hardened by heat to form a 3 mm thick silicone rubber layer 31*b*. The pressure roller molded through the above steps was removed from the mold, and was further hardened.

In this embodiment, the fixing nip N was formed by placing the pressure roller 31 in contact with the heater 12, interposing the fixing film 10, with an overall contact pressure of 10 kg.

The fixing film 10 as the heating member was a seamless tube of 40 $\mu$m thick polyimide film coated with a 10 $\mu$m thick PTFE layer.

An electric power of 500 W was supplied to the heater 12 to rotate the pressure roller 31 at a velocity V of 150 mm/sec, which also was the same as the first embodiment.

Also in the same manner as the first embodiment, 1) slipping, and 2) mold releasing surface properties were evaluated.

Table 6 shows the evaluations of 1) and 2) which were made when the surface roughness Ra of the pressure roller 31 was varied by setting the weight ratio of the PPS to the PFA in the tube of heat resistant resin containing PFA, that is, the mold releasing layer 31*c* of the pressure roller 31, at 20:1, 10:1, 5:1 and 3:1.

TABLE 6

| Tube | | Surface roughness | | | | |
|---|---|---|---|---|---|---|
| | | Ra < 0.3 $\mu$m | Ra = 0.4 $\mu$m | Ra = 0.8 $\mu$m | Ra = 1.0 $\mu$m | Ra = 2.0 $\mu$m |
| PFA | (1) | N | N | G | G | G |
| $\mu$ = 0.2 | (2) | G | N | G | G | N |
| PFA + PPS | (1) | N | G | G | G | G |
| (20:1) | (2) | G | G | F | F | N |
| $\mu$ = 0.35 | | | | | | |
| PFA + PPS | (1) | G | G | G | G | G |
| (10:1) | (2) | G | G | F | N | N |
| $\mu$ = 0.43 | | | | | | |
| PFA + PPS | (1) | G | G | G | G | G |
| (5:1) | (2) | G | F | N | N | N |
| $\mu$ = 0.6 | | | | | | |
| PFA + PPS | (1) | G | G | G | G | G |
| (3:1) | (2) | N | N | N | N | N |
| $\mu$ = 0.65 | | | | | | |

The values of the dynamic friction coefficients $\mu$ of the tubes in the table shows the values obtained using the same measuring method as that used in the first embodiment.

The conditions, in which the slipping, and the contamination of the pressure roller do not occur, can be realized when the surface roughness Ra of the pressure roller, and the dynamic friction coefficient $\mu$ satisfy the relationship described in the first embodiment.

Further, according to this embodiment, when the dynamic friction coefficient $\mu$ is no less than 0.65, the contamination of the pressure roller occurs regardless of the surface roughness Ra. These numerical values show that the contamination of the pressure roller correlates to the peripheral velocity of the pressure roller as in the first embodiment; therefore, the mathematical formulas given in the first embodiment are applicable to this embodiment without modification.

Thus, when the resin tube as the mold releasing layer 31*c* of the pressure roller is composed of a compound material made by mixing highly heat resistant resin, excluding fluorinated resins, into PFA resin, such a problem as tearing of the tube due to the deterioration of the tube strength does not occur even when the pressure roller with the rube is subjected to an extended fixing operation in which the overall pressure exceeds 7 kg. Therefore, it is possible to provide a pressure roller suitable for increasing the process speed of an image forming apparatus.

Embodiment 3

The thermal fixing apparatus in this embodiment employed the same structure as those in the first and the second embodiments, except for a modification made to form a nip wide enough to deal with a much higher process speed.

The resin tube as the mold releasing surface layer of the pressure roller had a relatively high degree of hardness, which was liable to make the overall hardness of the pressure roller relatively high even when the hardness of the rubber layer, that is, the under layer, was reduced. Therefore, researches were made on the tube structure in order to provide a pressure roller which has sufficient heat resistance and strength to withstand even a higher pressure, as well as a sufficient nip width to deal with a higher process speed. As a result, the pressure roller described in this embodiment was obtained, which was characterized in that the resin tube as the surface layer 41*c* of the pressure roller was composed of a material made by mixing a silicone rubber, fluorine rubber, or the like, excluding fluorinated resin, which had high heat resistance and a high friction coefficient, into PFA resin.

Figure 6:
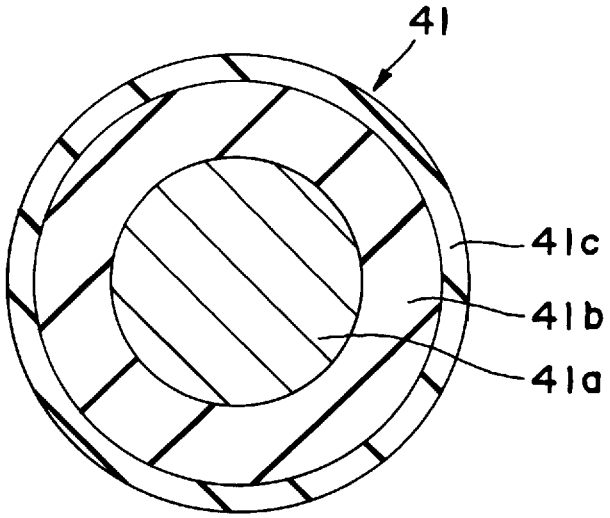
FIG. 6 is a sectional view of the pressure roller structure in another embodiment of the present invention.

The laminated structure of the pressure roller 41 is as shown in FIG. 6. The structure of the thermal fixing apparatus was the same as that of the first embodiment; therefore, the description thereof will be omitted.

In this embodiment, the mold releasing layer 41*c* of the pressure roller 41 was a tube composed of a compound material made by mixing a rubber material such as silicone rubber, fluorinated rubber, or the like, which had high heat resistance and a high friction coefficient, into PFA. It was manufactured by extruding a mixture of PFA pellets and a predetermined amount of heat resistant rubber such as silicone rubber in the pellet form.

The essential steps for manufacturing the pressure roller were the same as those described in the first embodiment. First, a 50 μm thick tube of the heat resistant rubber containing PFA, which would become the mold releasing layer 41*c,* was coated with primer, on the internal surface, and then was placed in a cylindrical roller mold. Next, the surface of the metallic core 41*a* of aluminum was roughened by blasting, and cleansed. Then, the metallic core 41*a* was set at the center of the cylindrical roller mold. Thereafter, liquid silicone rubber was injected into the space between the metallic core 41*a* set at the center of the mold, and the resin tube 41*c,* and was hardened by heat to form a 3 mm thick silicone rubber layer 41*b.* The pressure roller molded through the above steps was removed from the mold, and was further hardened.

In this embodiment, the fixing nip N was formed by placing the pressure roller 41 in contact with the heater 12, interposing the fixing film 10, with an overall contact pressure of 10 kg.

The fixing film 10 as the heating member was a seamless tube of 40 μm thick polyimide film coated with a 10 μm thick PTFE layer.

An electric power of 500 W was supplied to the heater 12 to rotate the pressure roller 41 at a velocity V of 150 mm/sec.

Also in the same manner as the first embodiment, 1) slipping, and 2) mold releasing surface properties, were evaluated.

Table 7 shows the evaluations of 1) and 2) which were made when the surface roughness Ra of the pressure roller 41 was varied by setting the weight ratio of the silicone rubber to the PFA in the tube of PFA containing heat resistant rubbers that is, the mold releasing layer 41*c* of the pressure roller 41, at 30:1, 15:1, 10:1 and 5:1.

TABLE 7

| Tube | | Surface roughness | | | | |
|---|---|---|---|---|---|---|
| | | Ra < 0.3 μm | Ra = 0.4 μm | Ra = 0.8 μm | Ra = 1.0 μm | Ra = 2.0 μm |
| PFA | (1) | N | N | G | G | G |
| μ = 0.2 | (2) | G | G | G | G | N |
| PFA + Si | (1) | N | G | G | G | G |
| rubber | (2) | G | G | F | F | N |
| (30:1) | | | | | | |
| μ = 0.31 | | | | | | |
| PFA = Si | (1) | G | G | G | G | G |
| rubber | (2) | G | G | F | N | N |
| (15:1) | | | | | | |
| μ = 0.47 | | | | | | |
| PFA + Si | (1) | G | G | G | G | G |
| rubber | (2) | F | F | N | N | N |
| (10:1) | | | | | | |
| μ = 0.55 | | | | | | |
| PFA + Si | (1) | G | G | G | G | G |
| rubber | (2) | N | N | N | N | N |
| (5:1) | | | | | | |
| μ = 0.7 | | | | | | |

The values of the dynamic friction coefficients μ of the tubes in the table shows the values obtained using the same measuring method as that used in the first embodiment.

The conditions, in which the slipping and the contamination of the pressure roller do not occur, can be realized when the surface roughness Ra of the pressure roller 41, and the dynamic friction coefficient μ satisfy the relationship described in the first and second embodiments. In other words, the mathematical formulas given in the first embodiment are also applicable to this embodiment without modification.

Further, in this embodiment, highly heat resistant rubber material was mixed into the PFA resin; therefore, a problem such as tearing of the tube due to the deterioration of the tube strength did not occur even when the tube roller was tested in durability in a condition in which the overall pressure exceeded 7 kg, and at the same time, the hardness of the tube was relatively reduced, providing a sufficient nip width even when the pressure was not increased to an extremely high level. Therefore, it is possible to provide a pressure roller suitable for further increasing the process speed of an image forming apparatus.

Figure 7:
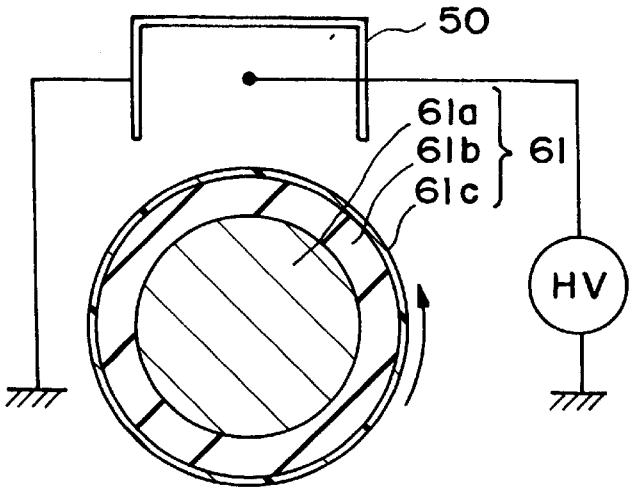
FIG. 7 is a schematic drawing describing a method for improving the tube surface (treatment by corona discharge).

Embodiment 4 (FIG. 7)

In this embodiment, a PFA tube where surface was slightly activated by a treatment such as elastic discharge, for example, corona discharge, was employed as the resin tube as the mold releasing surface layer of the pressure roller. With this treatment, the dynamic friction coefficient μ was increased without sacrificing the heat resistance of the PFA tube.

FIG. 7 is a schematic drawing concisely describing a surface activating process in which electric discharge was used. The pressure roller 61 was manufactured through the same steps as those of the first embodiment. As for the mold releasing surface layer 61*c* of the pressure roller, a tube composed of pure PFA was employed.

The surface of the pressure roller 61 was exposed to a corona discharge of the negative polarity using a corona discharger 50, in order to activate the surface of the PFA tube as the mold releasing layer 61*c*.

The corona of the negative polarity was generated by applying a high voltage of −7 KV to the corona discharger 50, and the pressure roller 61 was rotated at a predetermined peripheral velocity (20 rpm–100 rpm) to activate its surface in the atmosphere of the corona.

When the surface of the pressure roller 61 was to be roughened, the surface activation was carried out after the tube surface was roughed by blasting or the like method.

During the surface activating operation, the duration of the activation process was changed to adjust the dynamic friction coefficient μ as well as the surface roughness Ra of the pressure roller so that the specifications of the pressure roller 61 obtained through the steps described in the foregoing could agree with the same numerical value range (dynamic friction coefficient and surface roughness) as that in the second and third embodiment. As a result, it was possible to provide a driving pressure roller which did not slip, and was sufficiently durable, The mathematic formulas presented in the first embodiment was also applicable to this embodiment without modification.

It should be noted here that the surface activating process carried out in this embodiment was a surface modification process at a molecular level; therefore, compared to the dispersion based friction coefficient control described in the third embodiment, the process of this embodiment could control the friction coefficient imiore uniformly across the surface to be activated. It is evident from this result that the method employed in this embodiment can easily stabilize the pressure roller quality.

Further, in this embodiment, a surface property modification based on the corona discharge was described.

However, effects similar to those described in this embodiment can also be obtained when the surface properties are modified by etching.

Figure 8A:
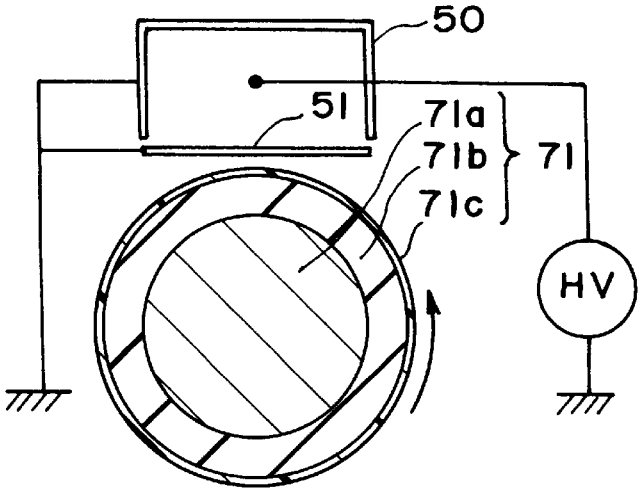
FIG. 8(*a*) is a schematic drawing describing another method for improving the tube surface (treatment by corona discharge), and FIG. 8(*b*) is a plan view of the grid of a corona discharger.
Figure 8B:
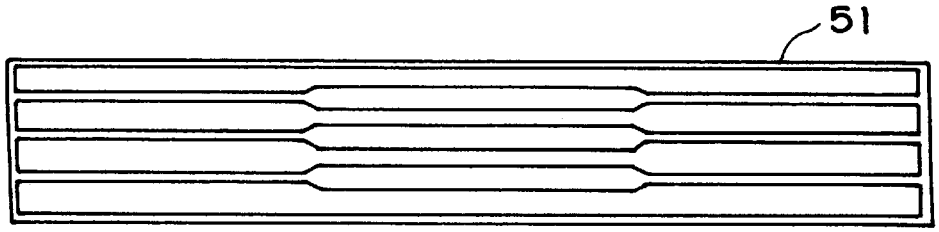

Embodiment 5 (FIG. 8)

In this embodiment, the surface of the PFA tube was activated by a method similar to that in the fourth embodiment, except that the distribution of the corona was modified to expose the longitudinal end portions of the pressure roller 71 to a larger amount of the corona than the central portion thereof. With this arrangement, the dynamic friction coefficient $\mu$, in particular, the dynamic friction coefficient $\mu$ toward the longitudinal end portions, could be increased without sacrificing the heat resistance of the PFA tube 71*c*. Other structures and conditions were the same as those in the fourth embodiment.

In this embodiment, a corona discharger 50 comprising a grid 51, as shown in FIG. 8(*a*), was employed. The grid 51 was flat as shown in FIG. 8(*b*), wherein the distribution of the corona was controlled by differentiating the grid interval between the center portion and the end portions in the longitudinal direction of the corona discharger 50.

During the surface activating operation, the duration of the activation process was changed to adjust the dynamic friction coefficient $\mu$ as well as the surface roughness Ra of the pressure roller so that the specifications of the pressure roller 61 obtained through the steps described in the foregoing could agree with the same numerical value range (dynamic friction coefficient and surface roughness) as that in the second and third embodiment. As a result, it was possible to provide a driving pressure roller which did not slip, and was sufficiently durable. The mathematical formulas presented in the first embodiment were also applicable to this embodiment without modification.

According to this embodiment, the dynamic friction coefficient of the pressure roller is higher across the center portion than the end portions, which makes the driving force of the pressure roller stronger toward the end portions, creating a substantial force which acts to pull the film 10 toward both end portions; therefore, even when the thickness of the fixing film 10 is reduced, crumpling or the like deformation of the fixing film 10 is not likely to occur, enabling the fixing film to be reliably run, while improving the thermal conductivity of the fixing film 10. Therefore, the pressure roller in this embodiment has an advantage in that it can deal with a far higher process speed.

As described above, the surface activating process carried out in this embodiment was a surface modification process at a molecular level; therefore, compared to the dispersion based friction coefficient control described in the second and third embodiment, the process of this embodiment could control the friction coefficient more uniformly across the surface to be activated. Therefore, not only can the pressure roller quality be stabilized, but also, it is possible to provide the tube surface with a predetermined pattern of the dynamic friction coefficient distribution such as the one described in this embodiment, offering an additional advantage in that the fixing film can be stably run.

Further, in this embodiment, a surface property modification based on the corona discharge was described. However, effects similar to those described in this embodiment can also be obtained when the surface properties are modified by etching.

Figure 9:
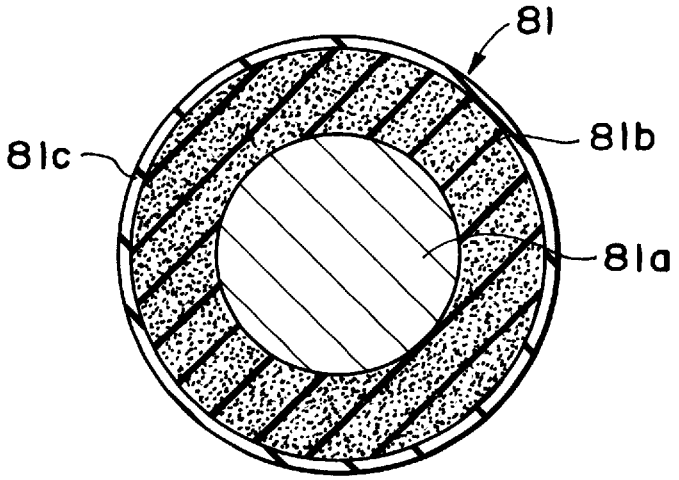
FIG. 9 is a schematic sectional view of the pressure roller structure in which the elastic layer is composed of sponge material.
Figure 10:
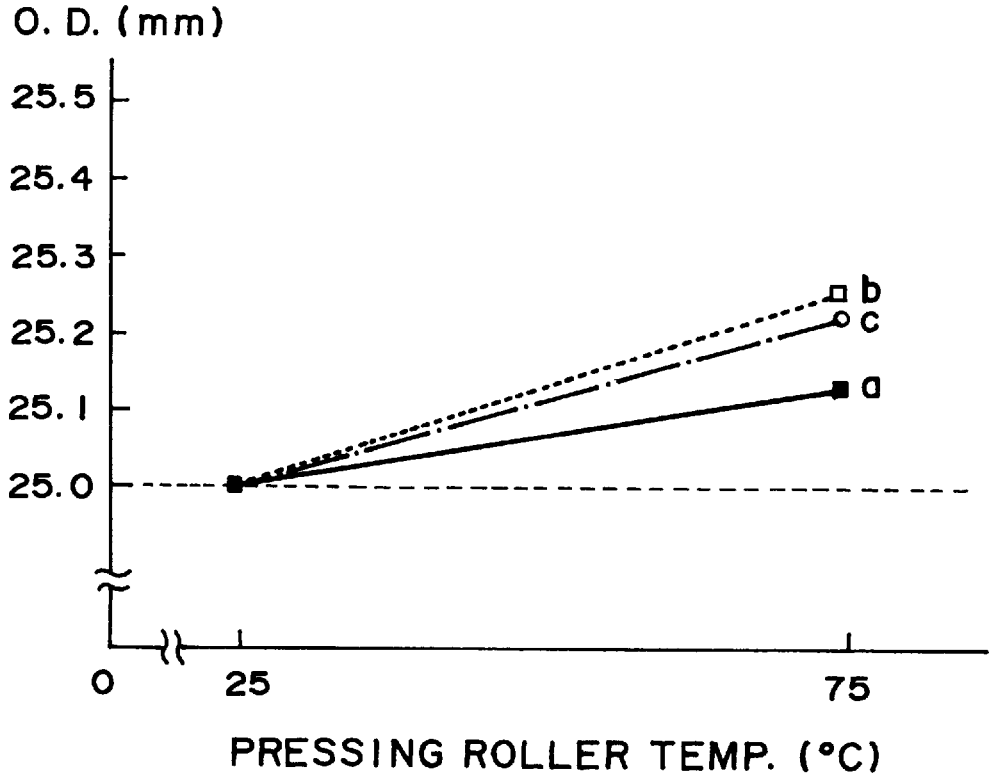
FIG. 10 is a graph showing the change in the external diameter of a pressure roller.

Embodiment 6 (FIGS. 9 and 10)

FIG. 9 is a schematic cross-section of the laminated structure of the pressure roller in this embodiment.

This pressure roller 81 comprised an aluminum core 81*a* with a diameter of 16 mm, a 4 mm thick silicone sponge layer 11*b*, and a 50 $\mu$m thick mold releasing layer 81*c* laminated on the silicone sponge layer, wherein the layer 81*c* is constituted of a tube composed of PFA containing heat resistant rubber material. The pressure roller of this embodiment also satisfies the mathematical formulas presented in the first embodiment.

When the pressure roller 81 with the above structure is employed, not only can the resin tube 81*c* as the surface layer produce the same effects as those described in the preceding embodiments, but also the external diameter change, which occurs to the pressure roller 81 due to thermal expansion, can be reduced.

FIG. 10 shows the external diameter change of the pressure roller when the pressure roller 81 was heated:

- solid line a represents the pressure roller 81 of this embodiment, which comprised an elastic layer 81*b* of silicone sponge, and a surface layer 81*c* constituted of the resin tube layer;
- broken line b presents a pressure roller comprising an elastic layer of solid (nonporous) silicone rubber, and a surface layer constituted of the same resin tube layer as that of this embodiment;
- single dot chain line c represents a pressure roller comprising only a silicone rubber sponge layer disposed on a core (shaft), lacking the resin tube layer as the surface layer;
- wherein the pressure roller temperature is plotted on the abscissa, and the amount of the external diameter change of the pressure roller is plotted on the axis of ordinate.

As is evident from this graph, in the case of the pressure roller represented by the solid line a, even when the pressure roller temperature increases 50° C. above the room temperature, the external diameter change is only 0.13 mm, but in the case of the pressure roller represented by the broken line b and the single dot chain line c, the external diameter change are 0.25 mm and 0.22 mm, respectively, which are relatively large changes.

This is because not only could the phenomenon that the sponge layer increases its volume due to thermal expansion be suppressed by the provision of the resin tube layer as the surface layer, but also could the increased amount of the sponge layer be absorbed by the pores within the sponge layer; the external diameter change due to the thermal expansion can be more effectively reduced.

In this embodiment, the pores of the sponge layer are preferred to be independent in terms of strength, but in terms of the enhancement of the above described effects, a certain portion of the pores are preferred to be continuous, since the presence of the continuous pore can effectively absorb the thermal expansion of the sponge layer by providing escape routes for the air. In order to balance the strength and the thermal expansion absorbing effect, the ratio of the continuous pores to the independent pores is preferred to be in a range of 20–40%.

As described above, when a resin tube is used as the mold releasing surface layer of the driving pressure roller 31, and a sponge layer containing a predetermined amount of continuous pores is used as the elastic layer 81, a thermal fixing apparatus capable of stabilizing the sheet conveyance speed can be provided.

Figure 11:
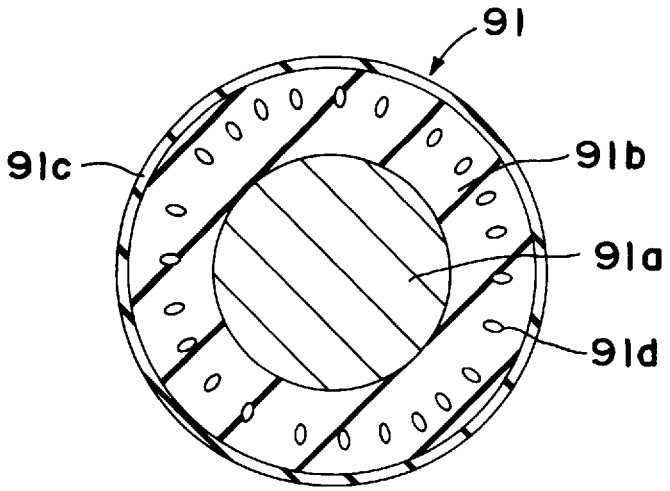
FIG. 11 is a schematic sectional view of the pressure roller whose elastic layer is composed of a porous rubber layer.
Figure 12:
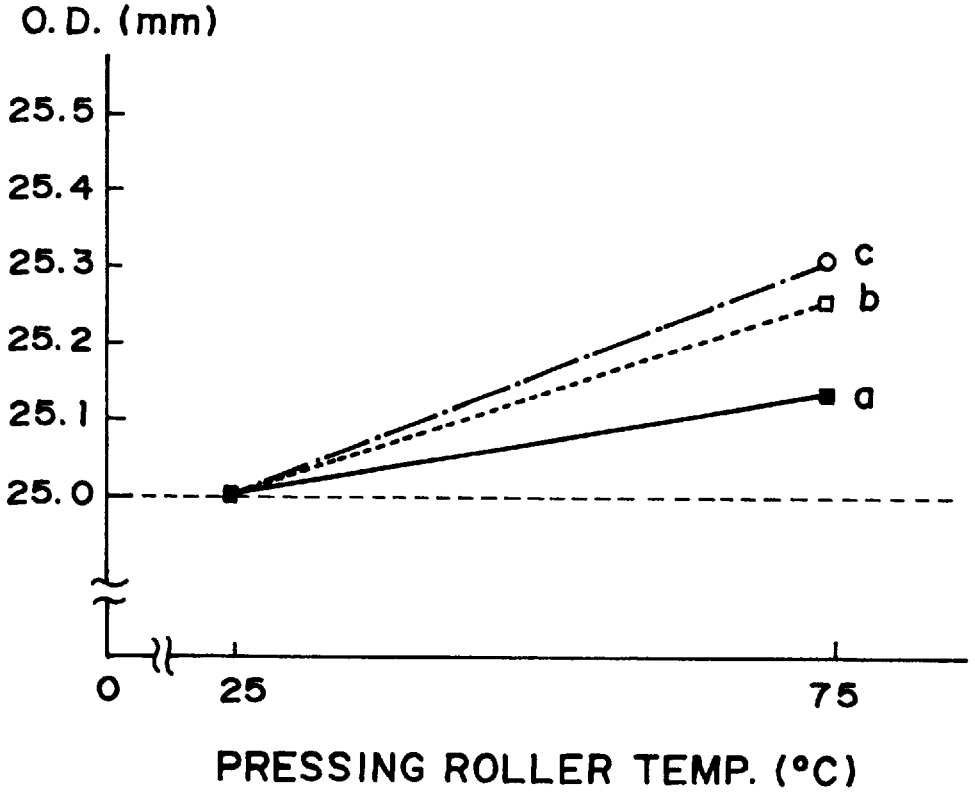
FIG. 12 is a graph showing the change in the external diameter of a pressure roller.

Embodiment 7 (FIGS. 11 and 12)

FIG. 11 is a schematic cross-section of the laminated structure of the pressure roller in this embodiment.

The pressure roller 91 in this embodiment comprised an aluminum core 91*a* with a diameter of 16 mm, a 3 mm thick silicone rubber layer 91*b* as the elastic layer formed on the peripheral surface of the core 91*a,* and a mold releasing layer 91*c* constituted of a 50 μm thick tube layer composed of PFA containing heat resistant rubber, wherein the silicone rubber layer 91*b* contained through holes 91*d* which extended in the longitudinal direction of the pressure roller 91.

The pressure roller 12 of this embodiment also satisfied the mathematical formulas presented in the first embodiment.

Not only could the surface layer 91*c* of the resin tube produced the same operational effects as those in the preceding embodiments, but also could the external diameter change of the pressure roller 91 due to the thermal expansion be reduced in same manner as it was in the sixth embodiment.

FIG. 12 shows the external diameter change of the pressure roller when the pressure roller 91 was heated:

solid line a represents the pressure roller 91 of this embodiment, which comprised an elastic layer 91*b* of silicone rubber containing the through holes 91*d* extending in the longitudinal (axial) direction of the pressure roller, and a surface layer 91*c* constituted of the resin tube layer;

broken line b presents a pressure roller comprising an elastic layer of silicone rubber lacking the through holes extending in the longitudinal (axial) direction of the pressure roller, and a surface layer constituted of the same resin tube layer as that of this embodiment:

single dot chain line c represents a pressure roller comprising only an elastic layer of silicone rubber containing the through holes extending in the axial (longitudinal) direction of the pressure roller, lacking the resin tube layer as the surface layer;

wherein the pressure roller temperature is plotted on the abscissa, and the amount of the external diameter change of the pressure roller is plotted on the axis of ordinate.

As is evident from this graph, in the case of the pressure roller represented by the solid line a, even when the pressure roller temperature increases 50° C. above the room temperature, the external diameter change was only 0.15 mm, but in the case of the pressure rollers represented by the broken line b and the single dot chain line c, the external diameter change were 0.25 mm and 0.3 mm, respectively, which were relatively large changes.

This is because not only could the phenomenon that the sponge layer increases its volume due to thermal expansion be suppressed by the provision of the resin tube layer as the surface layer, but also could the increased sponge layer volume be absorbed by the pores 91*d* within the rubber layer; it was possible to provide the pressure roller with a capability to more effectively reduce the external diameter change due to the thermal expansion.

In order to enhance the effects of the pressure roller in this embodiment, the size of the hole 91*d* contained in the elastic layer 91*b* of the pressure roller 91 is preferred to be in an diameter range of 0.5–2.0 mm. When it is no more than 0.5 mm, the thermal expansion cannot be effectively absorbed. When it is no less than 2.0 mm, the pressure roller cannot uniformly generate the fixing pressure throughout the surface thereof. The interval between the adjacent holes 91*d* is preferred to be in a range of 1.0–5.0 mm because of the same reason as that given regarding the size. As for the configuration of the hole 91*d,* an elongated elliptical as illustrated in FIG. 11 is effective to provide uniform pressure while enhancing the thermal expansion absorbing effects.

As described above, when a resin tube is used to form the mold releasing surface layer 91*c* of the driving pressure roller 91, and the through holes 91*d* are disposed through the elastic layer 91*b* in the axial direction, a thermal fixing apparatus capable of stabilizing the sheet conveyance speed can be provided.

Not only can a heating apparatus employing the heating film and the driving pressure roller, which were described in the preceding embodiments, be used as an image fixing thermal apparatus, but also it can be widely used as a general purpose heating apparatus; for example, an apparatus for modifying the surface properties (glossiness or the like) of a recording medium bearing an image by heating, an apparatus for temporarily fixing an image, and an apparatus for heating, drying, or laminating materials in the sheet form.

The heat resistant film 10 as the heating member does not need to be in the form of a cylinder or an endless belt; it does not need to be in the circularly rotatable form. Instead, it may be in the form of a roll of long web, which is driven through the nip by the pressure roller.

The heater 12 as the heat generating member is not limited to a ceramic heater. It may be an induction type heater comprising a means for generating a magnetic field, and a magnetic metal member. Further, the heat resistant film 10 as the heating member may be formed of exothermic film capable of generating heat by induction, wherein heat is generated from the heat resistant film 10 itself by the function of the magnetic field generated by the magnetic field generating means.

Needless to say, the pressure roller as the pressure generating rotary member comprising a metallic core, an elastic layer, and a mold releasing layer of a resin tube as the surface layer, may comprise optional functional layers which are laminated between the metallic core and the mold releasing surface layer.

The heating member 10 may be a metallic roller or the like.

Thus, when a pressure generating rotary member, which is placed in contact with an opposing member with a predetermined contact pressure in order to form a nip, and is rotatively driven to give a conveying force to a member disposed in the nip; a heating apparatus comprising such a pressure generating rotary member; or an image fixing thermal apparatus comprising such a heating apparatus, is provided with the structures characterized by the present invention, desirable effects can be obtained.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater;

a film;

a roller forming a nip with said heater with said film therebetween, said roller being driven to drive said film, wherein a recording material carrying an unfixed image is fed by the nip so that the unfixed image is fixed on the recording material by heat from said heater;

wherein said roller has a surface resin tube layer, and wherein a center line average surface roughness Ra (μm), a dynamic friction coefficient μ, and a peripheral speed V (mm/sec) of said roller satisfy:

when Ra<0.3, $$\mu \geqq 1.3\times10^{-3}V+0.18$$

when Ra≧0.3

$$0.37 \geqq Ra\times\mu \geqq 6.4\times10^{-4}V+4.8\times10^{-3}.$$

2. An apparatus according to claim 1, wherein said resin tube is of fluorine resin.

3. An apparatus according to claim 2, wherein said resin tube is of PFA.

4. An apparatus according to claim 1, wherein said resin tube has a surface subjected to blast treatment.

5. An apparatus according to claim 2, wherein said resin tube further comprises a resin material different from the fluorine resin.

6. An apparatus according to claim 1, wherein said resin tube further comprises a rubber material.

7. An apparatus according to claim 1, wherein said resin tube has a surface subjected to electric discharge treatment.

8. An apparatus according to claim 7, wherein said resin tube has a surface subjected more to the electric discharge treatment at an end portion then in a central portion thereof.

9. An apparatus according to claim 1, wherein said roller has an elastic layer inside said resin tube layer.

10. An apparatus according to claim 9, wherein said elastic layer is of sponge.

11. An apparatus according to claim 9, wherein said elastic layer has a hole.

12. An apparatus according to claim 11, wherein said hole penetrates said roller in its longitudinal direction.

13. An apparatus according to claim 1, wherein said roller is a pressing roller.

14. An apparatus according to claim 11, further comprising a guiding member far guiding movement of said film, wherein said film is an endless film, and is extended loosely around said guiding member.

15. An image fixing apparatus, comprising:

a roller cooperating with a member to form a nip for feeding a recording material carrying an unfixed image, wherein the unfixed image is fixed on the recording material while the recording material is fed through the nip; and driving means for driving said roller to feed the recording material;

wherein said roller has a surface resin tube layer, and wherein a center line average surface roughness Ra ($\mu$m), a dynamic friction coefficient $\mu$, and a peripheral speed V (mm/sec) of said roller satisfy:

when Ra 0.3, $$\mu \geqq 1.3\times10^{-3}V+0.18$$

when Ra$\geqq$0.3

$$0.37 \geqq Ra\times\mu \geqq 6.4\times10^{-4}V+4.8\times10^{-3}.$$

16. An apparatus according to claim 15, wherein said resin tube is of fluorine resin.

17. An apparatus according to claim 16, wherein said resin tube is of PFA.

18. An apparatus according to claim 15, wherein said resin tube has a surface subjected to blast treatment.

19. An apparatus according to claim 16, wherein said resin tube further comprises a resin material different from the fluorine resin.

20. An apparatus according to claim 15, wherein said resin tube further comprises a rubber material.

21. An apparatus according to claim 15, wherein said resin tube has a surface subjected to electric discharge treatment.

22. An apparatus according to claim 21, wherein said resin tube has a surface subjected more to the electric discharge treatment at an end portion then in a central portion thereof.

23. An apparatus according to claim 15, wherein said roller has an elastic layer inside said resin tube layer.

24. An apparatus according to claim 23, wherein said elastic layer is of sponge.

25. An apparatus according to claim 23, wherein said elastic layer has a hole.

26. An apparatus according to claim 25, wherein said hole penetrates said roller in its longitudinal direction.

27. An apparatus according to claim 15, wherein said member is a heater.

28. An apparatus according to claim 27, further comprising a film contactable with the unfixed image, and wherein said film is interposed between said heater and said roller.

29. An apparatus according to claim 15, wherein said roller is a pressing roller.

30. An apparatus according to claim 15, wherein said roller is free of heating source.

31. An image fixing apparatus, comprising:

a film;

a driving roller contactable to said film and for driving said film, wherein a recording material carrying an unfixed image is fed between said driving roller and said film to fix the unfixed image on the recording material; and wherein said driving roller has a surface resin tube layer of fluorine resin material, and said tube layer further comprises a resin material different from the fluorine resin material.

32. An apparatus according to claim 31, further comprising a heater cooperating with said driving roller to form a nip with said film interposed therebetween, wherein the resin material is heated at the nip by the heat from said heater.

33. An image fixing apparatus, comprising:

a film;

a driving roller contactable to said film and for driving said film, wherein a recording material carrying an unfixed image is fed between said driving roller and said film to fix the unfixed image on the recording material; and wherein said driving roller has a surface resin tube layer of resin material, and said tube layer further comprises a rubber material.

34. An apparatus according to claim 33, wherein said resin tube is of fluorine resin.

35. An apparatus according to claim 33, further comprising a heater cooperating with said driving roller to form a nip with said film interposed therebetween, wherein the resin material is heated at the nip by the heat from said heater.

36. An image fixing apparatus, comprising:

a film; and a driving roller contactable to said film and for driving said film, wherein a recording material carrying an unfixed image is fed between said driving roller and said film to fix the unfixed image on the recording material;

wherein said driving roller has a surface tube layer of resin material, said tube layer having a surface subjected to electric discharge treatment, and wherein axially end portions of said driving roller are subjected to the electric discharger to a greater extent than an axially central portion of said driving roller.

37. An apparatus according to claim 36, wherein said resin tube is of fluorine resin.

38. An apparatus according to claim 36, further comprising a heater cooperating with said driving roller to form a nip with said film interposed therebetween, wherein the recording material is heated at the nip by the heat from said heater.

* * * * *

UNITED STATES PATENT AND TRADEMARK OFFICE

CERTIFICATE OF CORRECTION

PATENT NO. : 5,860,051

DATED : January 12, 1999

INVENTOR(S) : MASAHIRO GOTO, ET AL.

It is certified that error appears in the above-identified patent and that said Letters Patent is hereby corrected as shown below:

COVER PAGE [57] ABSTRACT,
Line 5, "driving" should read --driven--.

COLUMN 1,
Line 53, "compound" should read --a compound--.

COLUMN 6,
Line 60, "roller 11." should read --roller 11--.

COLUMN 7,
Line 41, "was no occur," should read --was to occur--; and
Line 49, "wag" should read --was--.

COLUMN 8,
Line 9, "above described" should read --above-described--; and
Line 21, "fills" should read --fill--.

COLUMN 9,
Line 6, "a" should be deleted.

COLUMN 11,
Line 42, "the." should read --the--.

UNITED STATES PATENT AND TRADEMARK OFFICE

CERTIFICATE OF CORRECTION

PATENT NO. : 5,860,051

DATED : January 12, 1999

INVENTOR(S) : MASAHIRO GOTO, ET AL.

It is certified that error appears in the above-identified patent and that said Letters Patent is hereby corrected as shown below:

COLUMN 12,
Line 41, "rube" should read --tube--.

COLUMN 14,
Line 62, "imiore" should read --more--.

COLUMN 17,
Line 27, "embodiment:" should read --embodiment;--.

COLUMN 19,
Line 13, "then" should read --than--;
Line 24, "far" should read --for--; and
Line 63, "then" should read --than--.

Signed and Sealed this

Tenth Day of August, 1999

*Attest:*

Q. TODD DICKINSON

*Attesting Officer*

*Acting Commissioner of Patents and Trademarks*